US005634628A

United States Patent [19]

Schuch

[11] Patent Number: 5,634,628

[45] Date of Patent: Jun. 3, 1997

[54] WINCH MOUNTING SYSTEM HAVING WINCH TRANSLATING PORTION

[76] Inventor: Christopher C. Schuch, 25 Drabbington Way, Weston, Mass. 02193

[21] Appl. No.: 218,528

[22] Filed: Mar. 28, 1994

[51] Int. Cl.[6] ..... B66D 1/00

[52] U.S. Cl. ..... 254/331; 254/396; 384/58

[58] Field of Search ..... 254/331, 338, 254/395, 396, 392; 384/50, 58

[56] References Cited

U.S. PATENT DOCUMENTS

| | | | |
|---|---|---|---|
| 2,966,338 | 12/1960 | Simons . | |
| 3,456,899 | 7/1969 | Smith et al. | 254/331 X |
| 3,545,725 | 12/1970 | Chandler et al. . | |
| 3,708,152 | 1/1973 | Bulin . | |
| 3,804,370 | 4/1974 | Woodard . | |
| 3,836,122 | 9/1974 | Pierce, Jr. | 254/331 X |
| 4,007,887 | 2/1977 | Vice . | |
| 4,042,187 | 8/1977 | Snyder . | |
| 4,127,295 | 11/1978 | Robinson . | |
| 4,371,147 | 2/1983 | Ridgway . | |
| 4,650,163 | 3/1987 | Peterson . | |

*Primary Examiner*—Daniel P. Stodola
*Assistant Examiner*—Emmanuel M. Marcelo
*Attorney, Agent, or Firm*—Lappin & Kusmer LLP

[57] ABSTRACT

A winch mounting system includes a stationary mounting member and a winch supporting member slideably mounted thereon. Bearings permit the winch supporting member to move in a direction parallel to the rotational axis of the winch drum but restrain motion in all other directions. A fairlead or cable guide assembly, secured to the stationary mounting member, guides the cable to the drum. The tension on the cable forces the winch and drum to continually move to a position that maintains the shortest length of cable between the fairlead and the drum. As a result, the cable winds neatly and evenly on the drum without binding or bunching.

18 Claims, 7 Drawing Sheets

WINCH MOUNTING SYSTEM HAVING WINCH TRANSLATING PORTION

BACKGROUND OF THE INVENTION

This invention relates to an apparatus for mounting a winch to a vehicle or stationary object and in particular to an apparatus which enables the winch to wind the cable neatly on the reel and prevent the cable from bunching or binding.

Winches have been in common use for moving objects and vehicles for many years. In the typical application, one end of a long wire rope is securely attached to a stationary object while the other end is wound around the drum of a winch. In this manner, a winch is used to move a large object, for example, hoist a piano into a third story window or free a motor vehicle stuck in the mud. One will appreciate that the winch can just as likely be secured to the stationary object and the cable securely attached to the object to be moved.

The winch typically includes a high torque motor for rotating the drum. This motor can be for example, an electric motor with high torque gear reduction or a hydraulic motor. A brake or clutch can be provided to prevent unwanted slippage of the drum and to avoid damaging the motor. The drum and motor are fitted into a housing as a single unit which generally seals the internal gears and bearings from harmful elements. When the drum turns, the cable winds onto the drum and creates tension in the cable. As long as the cable is fed perpendicular to the rotational axis of the drum, the cable will generally wind evenly on the drum. However, it is more common that the cable is not fed perpendicular to the rotational axis of the drum and this causes the cable to migrate toward one side of the drum and wind itself only on that side of the drum. Consequently, the cable winds over itself, it jams (and possibly becomes damaged), whereby the cable must be unjammed and manually guided onto the drum evenly. The process may be repeated several times before the cable is completely wound on the drum. This method is not only time consuming and annoying, but also may significantly reduce the life of the cable. In addition, there is always the danger that the cable will break or become significantly weakened unknowingly.

These problems can be significant in off-road use. An off-road vehicle stuck on the side of an incline presents a precarious problem. If the cable begins to jam or bind, the winch has to stopped and the cable unjammed and wound evenly on the drum. The situation is inherently dangerous when there exists no means to secure the position of the vehicle. The winch cannot be released because the vehicle will roll back down the incline. In addition, the weight of the vehicle can make it very difficult and even impossible for the cable to be unjammed.

Accordingly, it is an object of this invention to provide an improved winch mounting apparatus.

It is another object of the invention to provide an improved winch mounting system which avoids bunching, binding or jamming of the cable on the drum.

It is yet another object of the invention to provide an improved winch mounting system which enables the cable to wind neatly around the drum.

It is still another object of the invention to provide an improved winch mounting system which enable the cable to wind neatly around the drum, irrespective of the angle the cable is fed to the winch.

SUMMARY OF THE INVENTION

The present invention relates to a winch mounting system which allows the winch itself to slide or move relative to the object it is mounted on. This permits the cable to wind neatly and evenly on the drum without binding or bunching. This is achieved even when the cable is fed to the winch at oblique angles to the rotational axis of the drum.

The winch mounting system includes a stationary mounting member or base member which can be securely mounted to an object, for example the bumper of a motor vehicle or a stationary platform. The stationary mounting member includes a set of friction reducing elements or bearings which support a winch supporting element. A winch, including a drum for winding cable, can be securely mounted to the winch supporting element. The winch supporting element and the winch are free to move in a direction substantially parallel to the rotational axis of the drum. The winch mounting system can also include a fairlead or cable guide to guide the cable from a fixed position with respect to the stationary mounting member to the drum.

In operation, the cable is fed through the cable guide to the drum. As tension in the cable increases, the winch will slide on the bearings to maintain the shortest distance between the cable and the cable guide, irrespective of the angle of the cable being fed into the cable guide. As the cable is wound on the drum, it interferingly engages the adjacent coil on the drum, this produces a force that moves the winch sidewards to enable the cable to wind next to the adjacent coil. As a result, the cable winds neatly and evenly on the drum.

BRIEF DESCRIPTION OF THE DRAWINGS

The foregoing and other objects of this invention, the various features thereof, as well as the invention itself, may be more fully understood from the following description, when read together with the accompanying drawings in which.

DETAILED DESCRIPTION OF THE PREFERRED EMBODIMENTS

FIGS. 1–4 show a winch mounting system in accordance with the present invention. The winch mounting system 10 includes a stationary mounting plate or base plate 30 which can be securely fastened to a stationary base or the bumper of a motor vehicle (not shown). Four bearing support arms 32A, 32B, 32C, 32D extend vertically above the stationary mounting plate 30 for supporting the upper support bearings 34A, 34B, 34C, 34D, the lower support bearing 36A, 36B, 36C, 36D and thrust bearings 38A, 38B.

Figure 1:
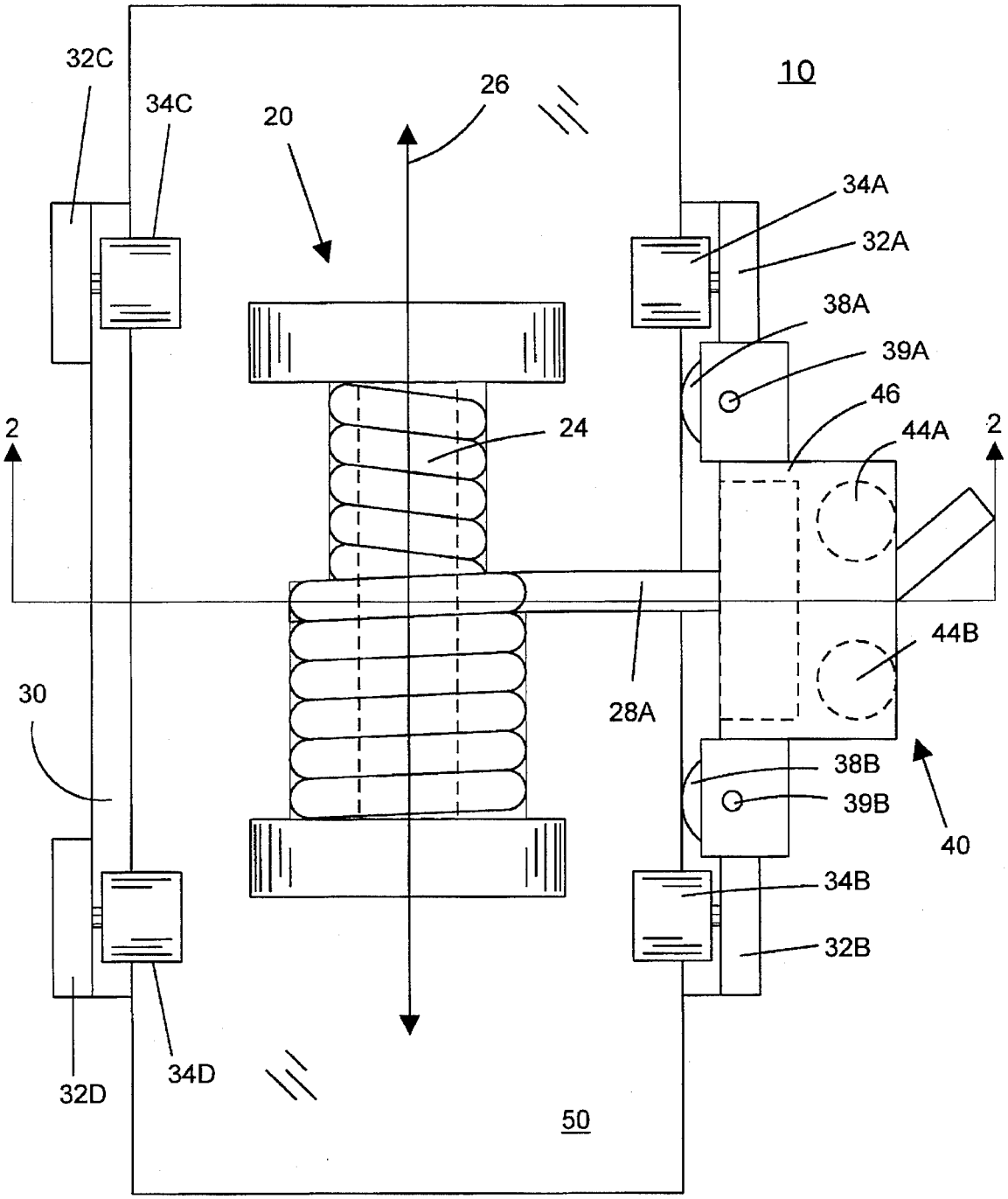
FIG. 1 is a diagrammatic top view of a winch mounting system in accordance with the present invention.
Figure 2:
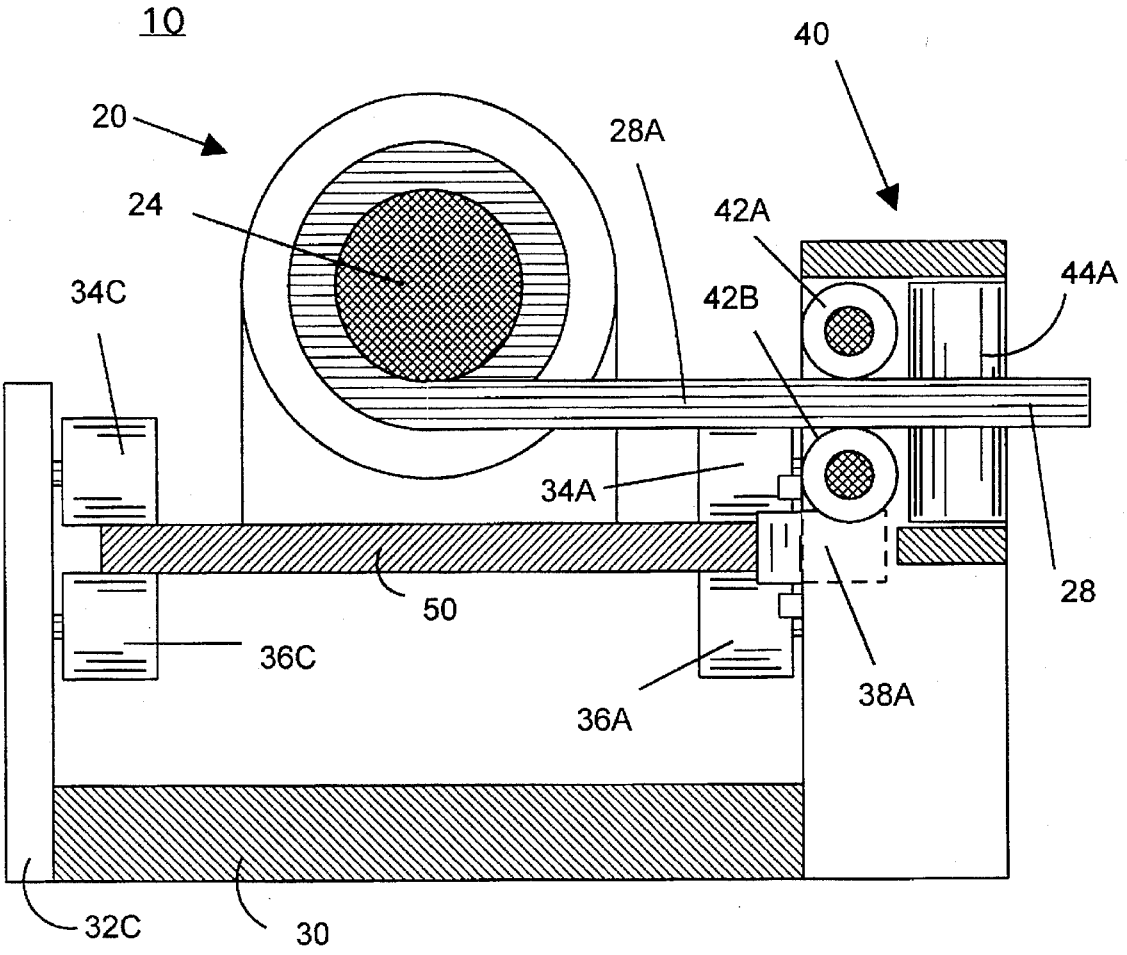
FIG. 2 is a diagrammatic cross-section of the side view taken along line 2—2 of FIG. 1.
Figure 3:
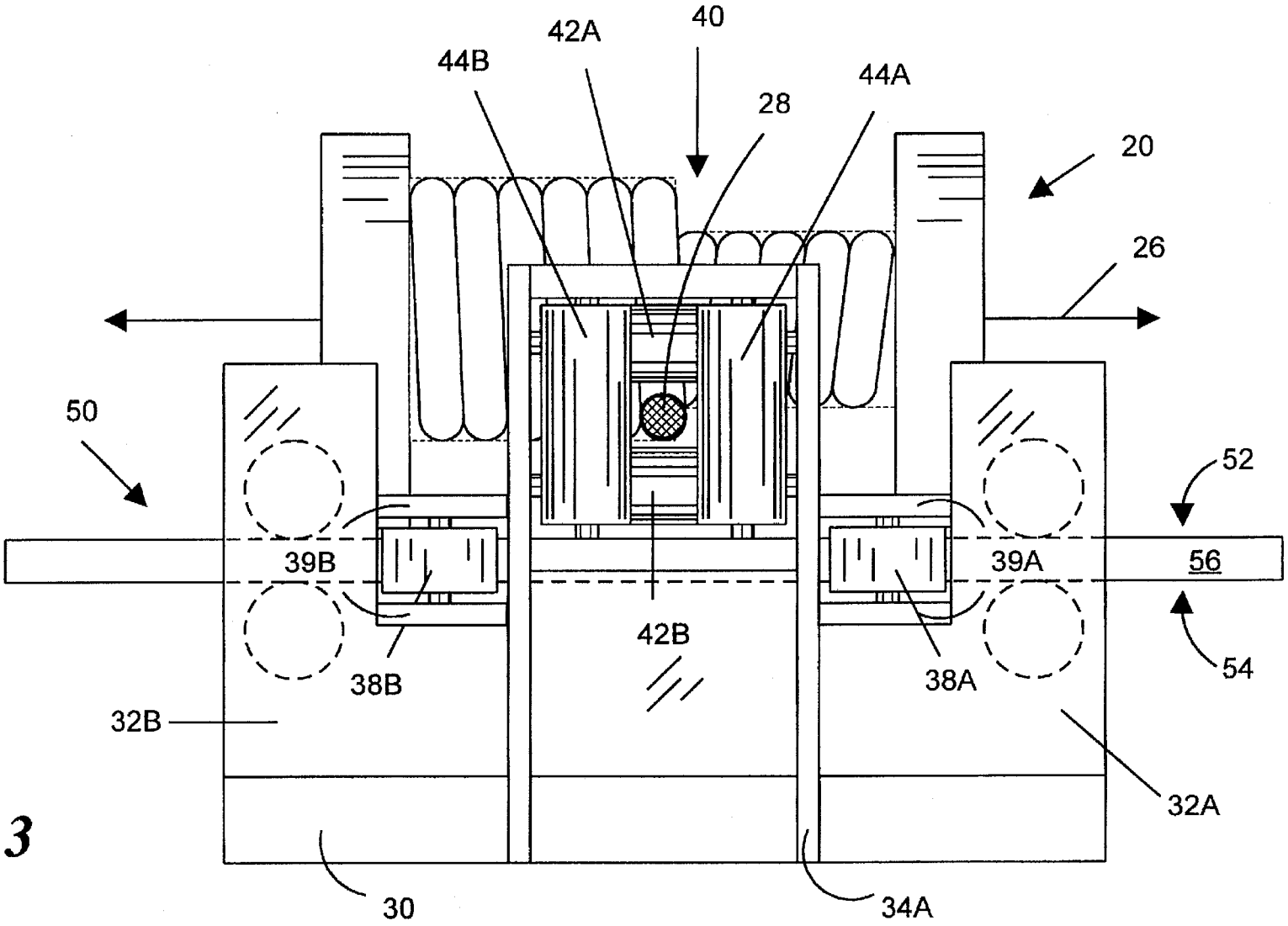
FIG. 3 is a diagrammatic front view of the winch mounting system shown in FIG. 1.
Figure 4:
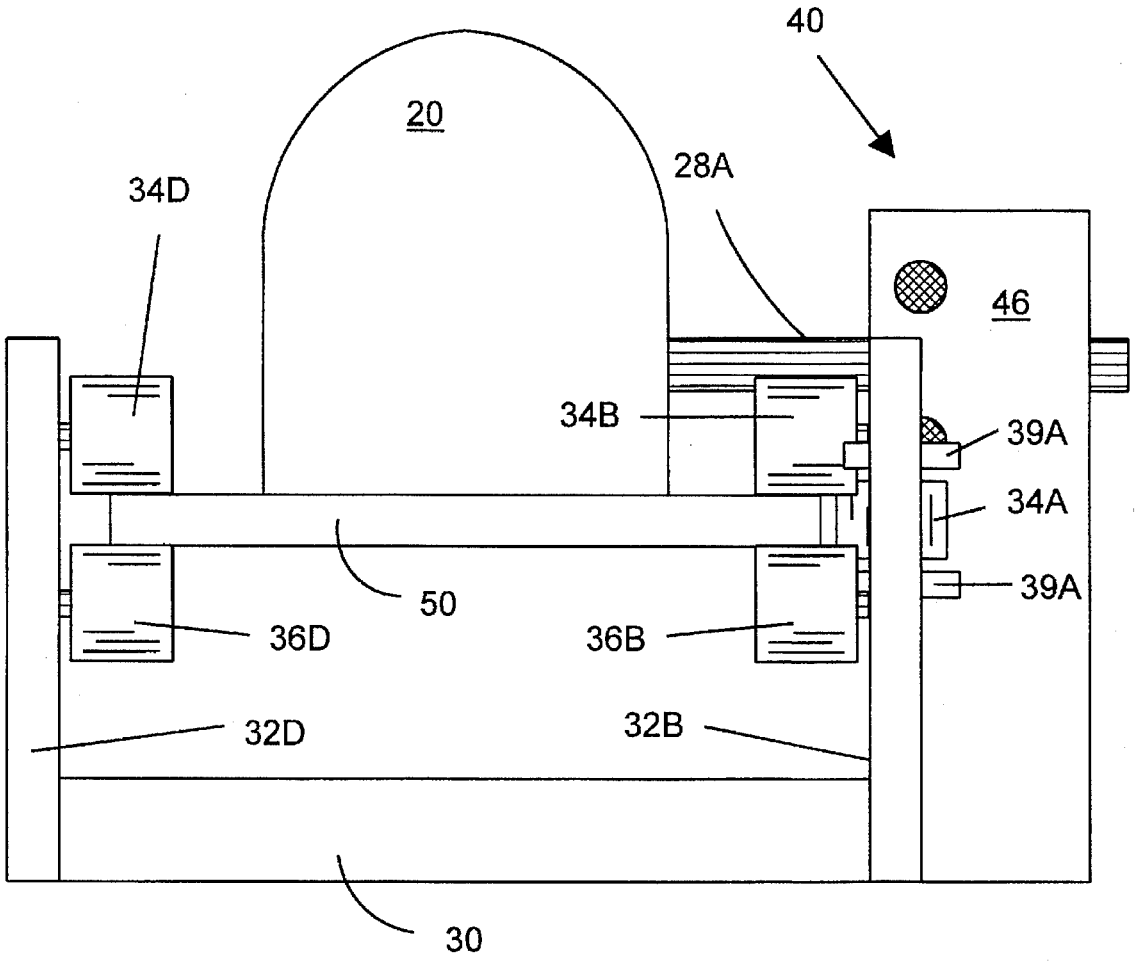
FIG. 4 is a diagrammatic side view of the winch mounting system shown in FIG. 1.

As shown in FIG. 1, the winch 20, including a drum 24 rotatable about a drum axis 26, is securely mounted on the sliding plate or winch support 50. As shown in FIGS. 2 and 3, the winch support 50 is mounted between the upper support bearings 34A, 34B, 34C, 34D and the lower support bearings 36A, 36B, 36C, 36D. The upper support bearings 34A, 34B, 34C, 34D engage the upper surface 52 of the winch support 50 and restrain it from moving in a upward vertical direction but permit it to slide in a horizontal direction substantially parallel to the axis of the drum 26. The lower support bearings 36A, 36B, 36C, 36D engage the lower surface 54 of the winch support 50 and restrain it from moving in a downward vertical direction but permit it to slide in a horizontal direction substantially parallel to the axis of the drum 26. Thrust bearings 38A, 38B engage the front surface 56 of the winch support 50 and restrain it from moving in the forward horizontal direction perpendicular to the axis of the drum but permit it to slide in the horizontal direction substantially parallel to the axis of the drum 26. In the preferred embodiment, the thrust bearings 38A, 38B are supported by flanges 39A, 39B securely affixed to the stationary mounting plate 30.

As shown in FIGS. 2 and 3, the winch mounting system 10 in accordance with the present invention can also include a fairlead or cable guide assembly 40. The cable guide assembly 40 includes a pair of parallel, spaced apart horizontal guide rollers 42A, 42B and a pair of parallel, space apart vertical guide rollers 44A, 44B for guiding the cable 28 to the drum 24. The cable 28 extends from the drum 24 through an opening defined by the horizontal guide rollers 42A, 42B and the vertical guide rollers 44A, 44B. In one preferred embodiment, each pair of guide rollers 42A–42B, 44A–44B are spaced such that there is only a minimum amount of clearance for the cable 28 to fit. The horizontal guide rollers 42A, 42B and the vertical guide rollers 44A, 44B can be mounted in a housing 46 which is securely affixed to the stationary mounting plate 30 in a substantially central position with respect to the support bearings 34, 36 and thrust bearings 38. It is not necessary for the cable guide assembly 40 to be mounted to the stationary mounting plate 30, it is only necessary that the cable guide assembly 40 be fixed in position with respect to the stationary mounting plate 30.

The cable guide assembly 40 may not be necessary when the cable 28 is fed to the drum 24 in a direction substantially perpendicular to the axis of the drum 26. For example, where the winch mounting system 10 is being used in a hoisting apparatus, such as a crane, and the cable is fed from a stationary pulley, the cable guide assembly 40 may not be needed.

In one preferred embodiment, the winch mounting system 10 is used to mount a winch 20 to the bumper of an off-road vehicle (not shown). The winch 20 can be either electrically or hydraulically driven. When the vehicle becomes stuck such as in mud or sand, the winch 20 is used to pull the vehicle free. The brake (not shown) on the winch 20 is released and the cable 28 is unwound. The free end is securely fastened to a stationary object such as a tree or another vehicle. To pull the vehicle free, the winch 20 is driven to pull the cable 28 through the cable guide assembly 40 and to wind it around the drum 24. As tension increases on the cable 28, the cable 28 is evenly and tightly wound around the drum 24. This is because the winch 20 and the drum 24 are free to move on the winch support 50, the drum 24 is compelled to keep the length of cable 28A between the drum 24 and cable guide assembly 40 as short as possible. As a result, the cable 28 winds neatly and evenly on the drum 24.

Preferably, the materials used to construct the stationary mounting plate 30 and the winch support 50 are determined by the maximum anticipated load and a margin of safety. In one preferred embodiment, the stationary mounting plate 30 is formed of ¼ inch thick hot rolled steel with the bearing support arms 32A, 32B, 32C, 32D, the thrust bearing support flanges 39A, 39B and the cable guide housing 46 welded or otherwise securely fastened thereto. The winch support 50 can be formed of ⅜ inch thick hot rolled steel as well and can include several common mounting hole patterns for mounting a winch. The ratings of the support bearings 34 and the thrust bearings 36 are also determined by the maximum anticipated load and a margin of safety. In the preferred embodiment, the support bearings and the thrust bearings are cam follower type needle roller bearings, part numbers YCRS18 and YCRS24 respectively and are commercially available from Torrington Bearing Co., Torrington, Conn. In addition, a greater or lesser number of bearings may be used in order to withstand a larger or smaller anticipated load, respectively.

Figure 5:
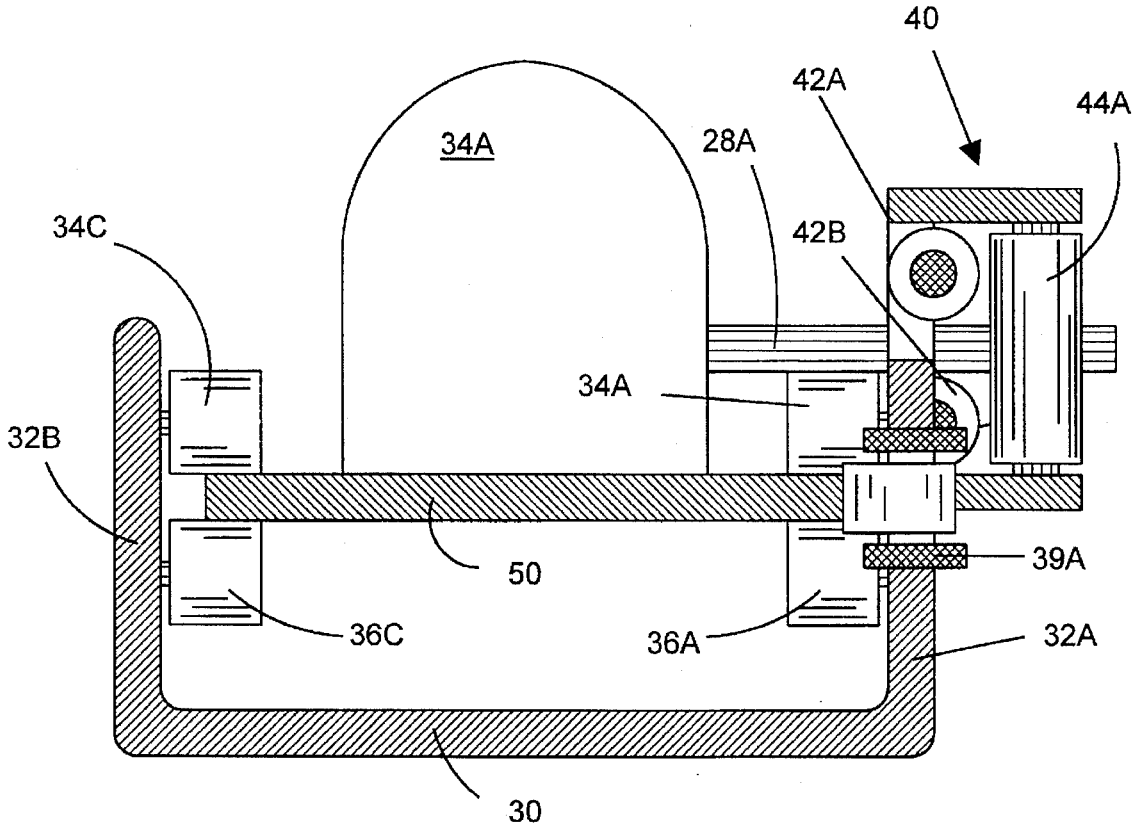
FIG. 5 is a diagrammatic cross-section of a side view of an alternative winch mounting system in accordance with the present invention.

As shown in FIG. 5, the stationary mounting plate 30 can be formed from a U-shaped channel having a horizontal base with a front upwardly extending flange 32A and a rear upwardly extending flange 32B. Upper support bearings 34A, 34B, 34C, 34D and lower support bearing 36A, 36B, 36C, 36D are mounted on the inside walls of front and rear flanges 32A, 32B. In a manner similar to that shown in FIG. 2, the thrust bearings 38A, 38B are mounted on flanges 39A, 39B, welded or otherwise secured to a rectangular opening in front flange 32A.

Figure 7:
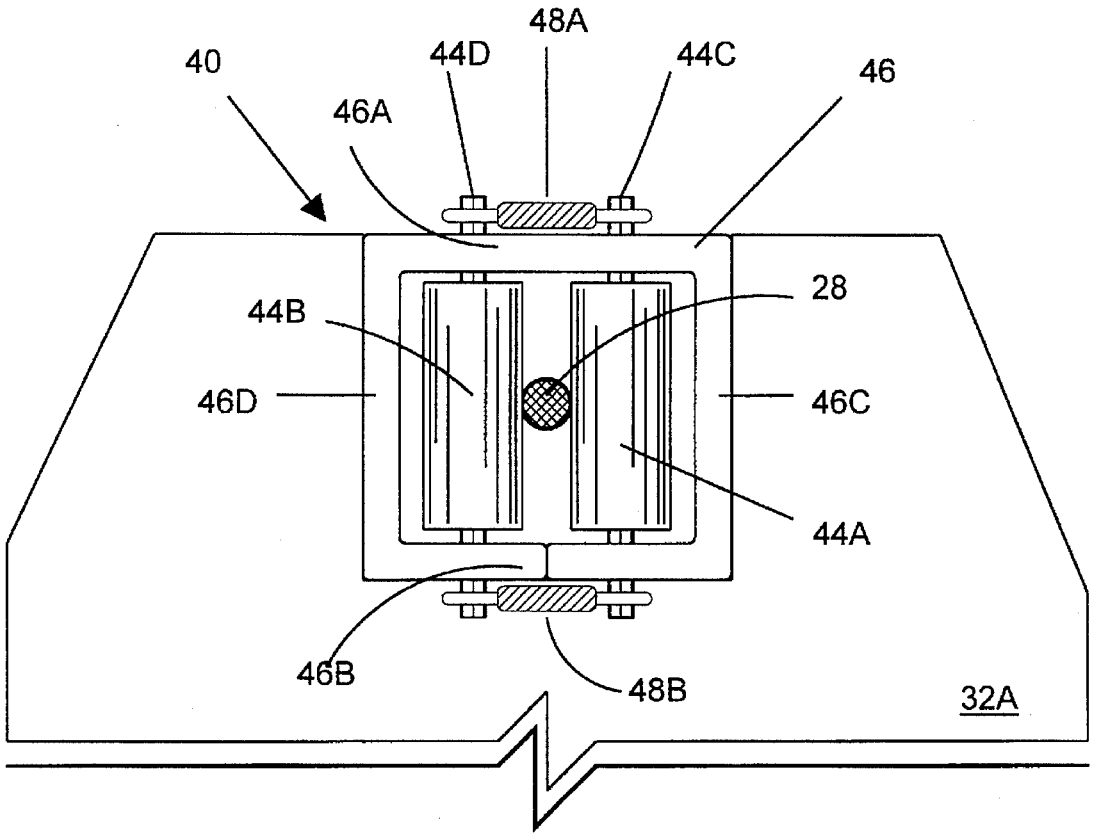
FIG. 7 is a diagrammatic front view of an alternative embodiment of a cable guide assembly in accordance with the present invention.

As shown in FIGS. 5 and 7, the cable guide assembly 40 can be formed from a rectangular or tubular housing 46 with horizontal 42A, 42B, and vertical 44A, 44B, guide rollers mounted therein. The housing 46 includes an upper wall 46A, a lower wall 46B and a pair of lateral side walls 46C, 46D. The housing 46 is welded or otherwise secured into a rectangular hole or slot in front flange 32A.

Figure 6:
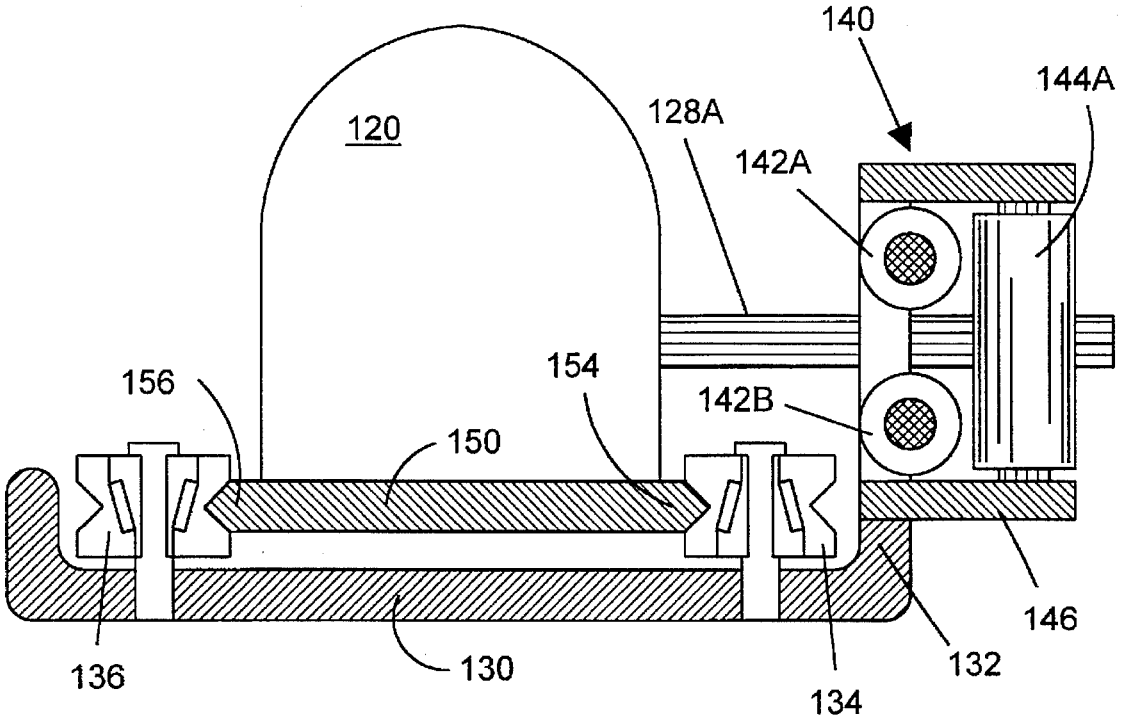
FIG. 6 is a diagrammatic cross-section of a side view of another alternative winch mounting system in accordance with the present invention.

FIG. 6 shows an alternative embodiment of the present invention. The stationary mounting plate 130 includes a vertical flange 132 for supporting a cable guide assemble 140 similar to that shown in FIGS. 5 and 6. The stationary mounting plate 130 includes front bearings 134 and rear bearings 136 having a V-shaped channel for receiving front 154 and rear 156 wedge shaped edges of winch support 150. In this embodiment, the bearings 134 and 136 are mounted to rotate about a vertical axis and perform the function of both the support bearings 34A, 34B, 34C, 34D, 36A, 36B, 36C, 36D and thrust bearings 38A, 38B of FIGS. 1–4.

In the preferred embodiment, the bearings 134 and 136 are thrust type needle bearings. As shown in FIGURE 6, front bearings 134 are oriented to resist force in the downward direction. Rear bearings 136 are oriented to resist force in the upward direction. This takes into account the moment forces on the winch support 150 which tend to move the front V-shaped edge 154 in a downward direction and rear V-shaped edge 156 in an upward direction.

FIG. 7 shows an alternative embodiment of the cable guide assembly 40 in accordance with the present, invention. In this embodiment, the cable guide assembly 40 provides a minimum of tension on the cable to enable it to wind neatly on the drum even when there is no load on the cable. This can be achieved by mounting support shafts 44C, 44D of the vertical rollers 44A, 44B in a slot which permits them to move with respect to each other to reduce the space between them. Each adjacent end the support shaft 44C, 44D is attached to a resilient element 48A, 48B, such as a spring or elastic band, which pulls the two vertical rollers 44A, 44B together. The two vertical rollers 44A, 44B pinch the cable 28 and provide a minimum of tension on the cable 28 to force it to wind neatly on the drum. In use, the tension on the cable 28, when not substantially perpendicular to the axis of the drum 26, will force the vertical rollers 44A, 44B apart thus removing the pinching force. It will be appreciated that the horizontal rollers 42A, 42B, either alternatively or in conjunction with the vertical rollers 44A, 44B, can be configured as just described to pinch the cable 28 to create the desired tension for no load winding.

The invention may be embodied in other specific forms without departing from the spirit or essential characteristics thereof. The present embodiments are therefore to be considered in respects as illustrative and not restrictive, the scope of the invention being indicated by the appended claims rather than by the foregoing description, and all changes which come within the meaning and range of the equivalency of the claims are therefore intended to be embraced therein.

What is claimed is:

1. A winch mounting system comprising:

a stationary mounting means for mounting said winch mounting system on an object, a winch support means for supporting a winch having a drum rotatable about a winch axis, cable guide means, fixedly coupled to said stationary mounting means, for guiding a cable substantially toward or away from said winch support means, and bearing means for movably supporting said winch support means on said stationary mounting means and for permitting movement of said winch support means with respect to said stationary mounting means along a path parallel to said winch axis, wherein said winch support means is free to move passively along said path in response to external forces applied to said winch support means.

2. A winch mounting system according to claim 1, wherein said bearing means restrains said winch support means from moving upward and from moving downward along a substantially vertical axis and permits motion in a direction substantially parallel to said winch axis but restrains said winch support means from moving along a second horizontal axis substantially perpendicular to said winch axis.

3. A winch mounting system according to claim 2, wherein said winch support means includes an upper surface, a lower surface, front surface and a back surface all extending substantially parallel to said winch axis, said bearing means comprises a first set of roller bearings for supporting said winch support means on said lower surface and restraining motion downward in a substantially vertical direction, a second set of roller bearings for supporting said winch support means on said upper surface and restraining upward motion in a substantially vertical direction and a third set of roller bearings for supporting said winch support means on said front surface and restraining motion in a forward horizontal direction perpendicular to said first horizontal direction.

4. A winch mounting system according to claim 1, wherein said winch support means includes an upper surface, a lower surface, front surface and a back surface all extending substantially parallel to said winch axis, said bearing means comprises a first set of roller bearings for supporting said winch support means on said lower surface and restraining motion in a substantially downward vertical direction, a second set of roller bearings for supporting said winch support means on said upper surface and restraining motion in a substantially upward vertical direction and a third set of roller bearings for supporting said winch support means on said front surface and restraining motion in a substantially forward direction.

5. A winch mounting system according to claim 1, wherein said cable guide means comprises a first pair of horizontally spaced apart guide rollers for restraining movement of said cable in a horizontal direction substantially perpendicular to a longitudinal axis of said cable, and a second pair of vertically spaced apart guide rollers for restraining movement of said cable in a vertical direction substantially perpendicular to the longitudinal axis of said cable.

6. A winch mounting system according to claim 5, wherein said first pair of guide rollers and said second pair of guide rollers define an opening through which said cable may pass.

7. A winch mounting system according to claim 5 wherein said cable guide means further comprises a tubular housing for containing and supporting said first pair of guide rollers and said second pair of guide rollers.

8. A winch mounting system according to claim 5 wherein said horizontally spaced apart guide rollers are rotatably mounted on vertical guide shafts and resilient tension means engage said vertical guide shafts for resiliently pressing said horizontally spaced apart guide rollers together.

9. A winch mounting system according to claim 1 wherein said cable guide means includes means for resisting the passage of the cable therethrough to create a minimum of tension on the cable between the winch and said cable guide means.

10. A winch mounting system according to claim 1 wherein said stationary mounting means comprises a substantially U-shaped channel having a substantially flat horizontal portion with a substantially vertical front flange portion and a substantially vertical rear flange portion extending from opposite sides thereof, and said bearing means being mounted on said front flange portion and said rear flange portion.

11. A winch mounting system according to claim 1 wherein said stationary mounting means comprises a substantially flat horizontal plate, said bearing means includes a plurality of bearings, each having a V-shaped channel on an outer surface thereof, and being mounted on said stationary mounting means, and said winch support means includes a wedge shaped front edge and a wedge shaped rear edge engaging and being supported by said V-shaped channels of said bearing means.

12. A winch mounting system according to claim 11 wherein said plurality of bearings are thrust bearings, said thrust bearings which support said front wedge shaped edge are oriented to resist forces in a downward direction, and said thrust bearings which support said rear wedge shaped edge are oriented to resist forces in an upward direction.

13. A winch mounting system comprising a winch support assembly including means for supporting a winch having a cylindrical drum rotatable about a winch axis, a base member, a cable guide assembly fixedly positioned with respect to said base member for guiding a cable toward or away from said winch support assembly, and means for coupling said winch support assembly to said base member whereby said winch support assembly is free to move passively with respect to said base member along a system axis in response to external forces applied to said winch support assembly, said system axis being substantially parallel to said winch axis.

14. A winch mounting system according to claim 13 wherein said means for coupling said winch support assembly to said base member includes bearing means for providing substantially frictionless movement of said winch support assembly with respect to said base member along said system axis.

15. A winch mounting system according to claim 14 wherein said winch support assembly includes a lower surface, an upper surface, a front surface and a rear surface, and said bearing means includes a lower bearing means engaging said lower surface for supporting said winch support assembly and restraining motion in a substantially downward vertical direction, an upper bearing means engaging said upper surface for supporting said winch support assembly and restraining motion in a substantially upward vertical direction and a front bearing means engaging said front surface for supporting said winch support assembly and restraining motion in a forward horizontal direction perpendicular to said winch axis.

16. A winch mounting system according to claim 13 wherein said cable guide assembly includes a pair of substantially vertical, parallel spaced apart guide rollers for restraining movement of the cable in a horizontal direction substantially parallel to said winch axis.

17. A winch mounting system according to claim 13 wherein said base member includes means for attaching said base member to an object.

18. A winch mounting system in combination with a winch comprising:

a winch support assembly including means for supporting a winch, a winch having a cylindrical drum rotatable about a winch axis, said winch being fixedly coupled to said means for supporting said winch, said winch including a cable a base member, a cable guide assembly fixedly positioned with respect to said base member for guiding said cable substantially toward or away from said drum, and means for coupling said winch support assembly to said base member whereby said winch support assembly is free to move passively with respect to said base member along a system axis in response to an external force applied to said winch support assembly, said system axis being substantially parallel to said winch axis.

* * * * *